US007822216B2

(12) United States Patent
Ohashi et al.

(10) Patent No.: US 7,822,216 B2
(45) Date of Patent: Oct. 26, 2010

(54) ELECTROACOUSTIC TRANSDUCER USING DIAPHRAGM AND METHOD FOR PRODUCING DIAPHRAGM

(75) Inventors: Yoshio Ohashi, Kanagawa (JP); Jun Kishigami, Saitama (JP); Masaru Uryu, Chiba (JP)

(73) Assignee: Sony Corporation, Tokyo (JP)

( * ) Notice: Subject to any disclaimer, the term of this patent is extended or adjusted under 35 U.S.C. 154(b) by 1123 days.

(21) Appl. No.: 11/482,789

(22) Filed: Jul. 10, 2006

(65) Prior Publication Data

US 2007/0014421 A1 Jan. 18, 2007

(30) Foreign Application Priority Data

Jul. 15, 2005 (JP) ..... 2005-207426

(51) Int. Cl.
*H04R 25/00* (2006.01)

(52) U.S. Cl. ..... 381/190; 381/430

(58) Field of Classification Search ..... 381/114, 381/173, 190, 430; 310/324, 328, 334, 800; 29/25.35

See application file for complete search history.

(56) References Cited

U.S. PATENT DOCUMENTS 4,843,275 A * 6/1989 Radice ..... 310/334
6,321,428 B1 * 11/2001 Toda et al. ..... 29/25.35
6,343,129 B1 1/2002 Pelrine et al.

FOREIGN PATENT DOCUMENTS

| | | |
|---|---|---|
| JP | 55-073199 | 6/1980 |
| JP | 55-73199 | 6/1980 |
| JP | 63-305700 | 12/1988 |
| JP | 07-260926 | 10/1995 |
| JP | 09-037394 | 2/1997 |
| JP | 2001-286162 | 10/2001 |
| JP | 2001-524278 | 11/2001 |
| JP | 2002-526004 | 8/2002 |
| JP | 2002-528887 | 9/2002 |

OTHER PUBLICATIONS

U.S. Appl. No. 11/485,967, filed Jul. 14, 2006, Ohashi.

* cited by examiner

*Primary Examiner*—Huyen D Le
(74) *Attorney, Agent, or Firm*—Oblon, Spivak, McClelland, Maier & Neustadt, L.L.P.

(57) ABSTRACT

An electroacoustic transducer has an cup chamber and a diaphragm made of deformable electrostrictive polymer, which is attached to an opening of the chamber. The electroacoustic transducer also has first and second adaptive electrode layers formed on a front surface and a rear surface of the diaphragm, across which audio signal voltage biased by a direct-current biased voltage is applied. The first and second adaptive electrode layers have shapes that are adjustable according to a change in a shape of the diaphragm. The diaphragm is formed to make maximum a difference in air pressure of the front surface and the rear surface of the diaphragm, thereby forming any one of concave and convex shapes thereof.

3 Claims, 4 Drawing Sheets

ELECTROACOUSTIC TRANSDUCER USING DIAPHRAGM AND METHOD FOR PRODUCING DIAPHRAGM

CROSS REFERENCE TO RELATED APPLICATION

The present invention contains subject matter related to Japanese Patent Application JP 2005-207426 filed in the Japanese Patent Office on Jul. 15, 2005, the entire contents of which being incorporated herein by reference.

BACKGROUND OF THE INVENTION

1. Field of the Invention

The present invention relates to an electroacoustic transducer such as a speaker using a diaphragm made of deformable electrostrictive polymer and a method for producing the diaphragm used in the electroacoustic transducer.

2. Description of Related Art

Proposed has been an electroacoustic transducer having a diaphragm and an electrode layers across which an audio signal voltage biased by a direct-current biased voltage is applied, that are placed on a front surface and a rear surface of the diaphragm. The electroacoustic transducer has used a difference in air pressure of the front surface and the rear surface of the diaphragm to form the concave or convex diaphragm so that it can convert any deformation of the diaphragm on its surface direction into any vibration in a thickness direction of the diaphragm, thereby emitting an audio signal. For example, the Japanese Patent Application Publication No. S55-73199 has disclosed the electroacoustic transducer in which a diaphragm made of polyvinylidene fluoride film as piezoelectric polymer has been used. Further, International Application No. PCT/US98/02311 (International Publication No. WO 98/3529) has disclosed a sonic actuator in which a diaphragm made of elastomeric dielectric polymer has been used.

SUMMARY OF THE INVENTION

In order to use the diaphragms disclosed in the above publications as efficient diaphragms for emitting an audio signal, the difference in air pressure of the front surface and the rear surface of the diaphragm is very significant. The above publications, however, has disclosed no form of the diaphragm or no air pressure of the front surface and the rear surface of the diaphragm to form the diaphragm. Further, if the diaphragm is actuated under unsuitable air pressure, it can emit an audio signal inefficiently.

It is desirable to provide an electroacoustic transducer using a diaphragm that can emit the audio signal efficiently, and the like.

According to an embodiment of the invention, there is provided an electroacoustic transducer. The electroacoustic transducer has an cup chamber, a diaphragm made of deformable electrostrictive polymer, which is attached to an opening of the chamber, first and second adaptive electrode layers formed on a front surface and a rear surface of the diaphragm, across which audio signal voltage biased by a direct-current biased voltage is applied. The first and second adaptive electrode layers have shapes that are adjustable according to a change in the shape of the diaphragm. The diaphragm is formed to make maximum a difference in air pressure of the front surface and the rear surface of the diaphragm so that the diaphragm can be formed concave or convex.

On the embodiment of the invention, the diaphragm made of deformable electrostrictive polymer is attached to an opening of the cup chamber. The first and second adaptive electrode layers having shapes that are adjustable according to a change in the shape of the diaphragm are formed on a front surface and a rear surface of the diaphragm. This diaphragm is formed to make maximum a difference in air pressure of the front surface and the rear surface of the diaphragm so that the diaphragm can be formed concave or convex. When the diaphragm is formed, gas is supplied into the chamber or gas is exhausted from the chamber. When a difference in air pressure of the inside and outside of the chamber indicates maximum, supplying the gas into the chamber or exhausting it from the chamber is stopped.

The audio signal voltage biased by a direct-current biased voltage is applied across the first and second adaptive electrode layers. This enables the diaphragm to convert any deformation on its surface direction to any vibration on its thickness direction conforming to an audio signal, thereby emitting the audio signal from the diaphragm. In this case, since the diaphragm is formed to make maximum a difference in air pressure of the front surface and the rear surface of the diaphragm so that it can be formed concave or convex, maximum level of sound pressure that can be reproduced is raised, thereby allowing the diaphragm to emit the audio signal efficiently.

Thus, according to the embodiment of the invention, the diaphragm made of deformable electrostrictive polymer, which is attached to an opening of the cup chamber, is formed to make maximum a difference in air pressure of the front surface and the rear surface of the diaphragm so that the diaphragm can be formed concave or convex, thereby allowing the diaphragm to emit an audio signal efficiently.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

Figure 1:
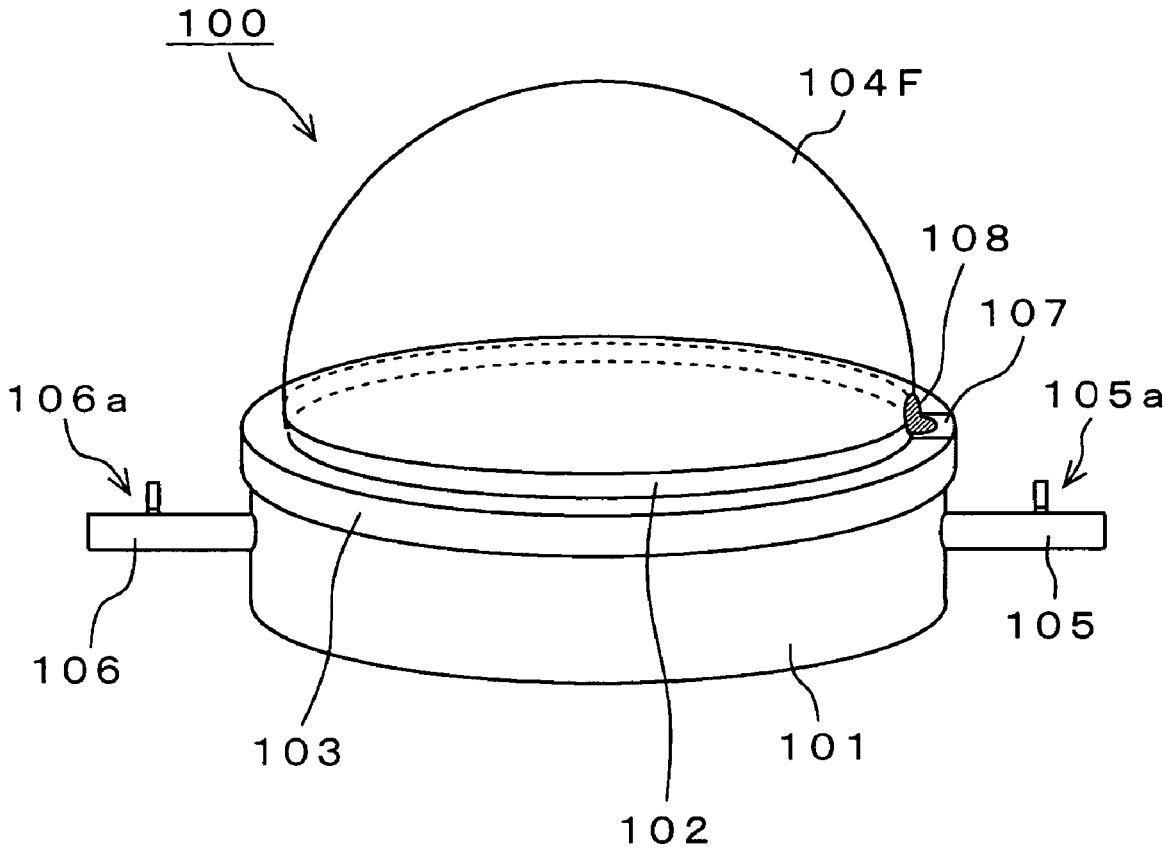
FIG. 1 is a perspective view of an electroacoustic transducer for showing a configuration of thereof according to an embodiment of the invention.
Figure 2:
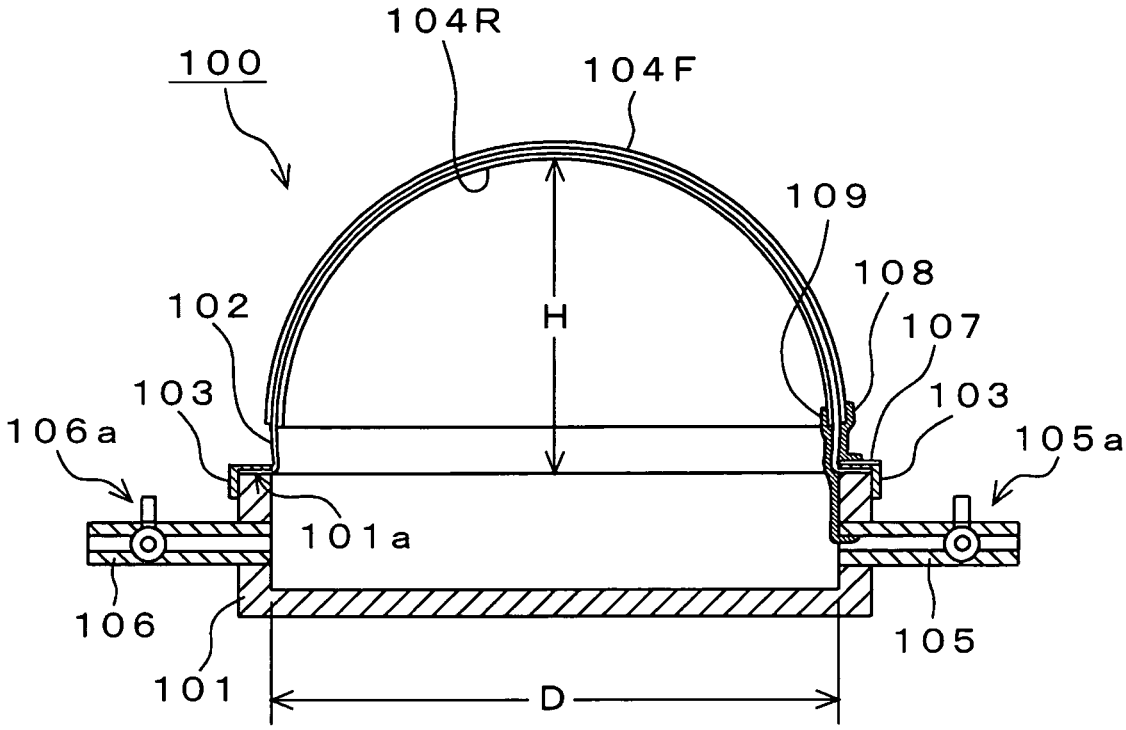
FIG. 2 is a cross-sectional view of the electroacoustic transducer for showing a configuration of thereof according to the embodiment of the invention.

The following will describe embodiments of an electroacoustic transducer of a preferred embodiment of the present invention with reference to drawings. FIG. 1 shows a configuration of the electroacoustic transducer 100 according to an embodiment of the invention. FIG. 2 is a cross-sectional view thereof.

In the electroacoustic transducer 100, the diaphragm 102 is attached to an opening end 101*a* of the cup chamber 101. In this case, a ring-shaped retainer 103 retains an end portion of the diaphragm 102 on the opening end 101*a* of the cup chamber 101. Thus, retaining the diaphragm 102 on the opening end 101*a* of the cup chamber 101 enables any enclosed space to be formed within the chamber 101.

The diaphragm 102 is made of deformable electrostrictive polymer. As the deformable electrostrictive polymer, acrylic elastomer VHB 4910 manufactured by 3M can be used. It is to be noted that an end portion of the diaphragm 102 may be adhered to the opening end 101*a* of the cup chamber 101 by any adhesives. The chamber 101 and the retainer 103 are made of non-conductive material, for example, synthetic resin.

To a front surface and a rear surface of the diaphragm 102, an adaptive electrode layer 104F and an adaptive electrode layer 104R are respectively applied and formed. Across these adaptive electrode layers 104F, 104R, audio signal voltage biased by a direct-current biased voltage is applied. These adaptive electrode layers 104F, 104R respectively refer to as electrode layers having shapes that are adjustable to a change in the shape of the diaphragm 102. As these adaptive electrode layers 104F, 104R, conductive silicon RTV rubber X-31-2060 manufactured by SHINETSU CHEMICAL KOGYO K.K., for example, can be used.

This diaphragm 102 is formed to make maximum a difference in air pressure of the front surface and the rear surface of the diaphragm 102 so that the diaphragm can be formed convex.

The following will describe formation of the diaphragm 102.

It is to be noted that a port 105 is provided on a position of a side wall of the chamber 101 to supply gas into the chamber 101 or exhaust gas from the chamber 101. A port 106 is also provided on another position of the side wall of the chamber 101 to measure air pressure inside the chamber 101. These ports 105, 106 are respectively made of metallic pipes and provided with open/close devices (cock mechanisms) 105*a*, 106*a*.

To the port 106, a measurement device, not shown, is attached to measure air pressure inside the chamber 101 with the open/close device 106*a* being set to its open position. It is because a difference in air pressure of the inside and the outside of the chamber 101 is finally obtained to measure the air pressure inside the chamber 101. As the measurement device, well-known water manometer, for example, can be attached to obtain the difference in air pressure easily.

To the port 105, a gas-supplying device, for example, a air compressor, not shown, is attached to supply gas into the chamber 101 with the open/close device 105*a* being set to its open position. In a situation just before the gas has been supplied into the chamber 101, there is no difference in air pressure between the inside and the outside of the chamber 101, thereby making the diaphragm 102 flat as its initial state.

Figure 3:
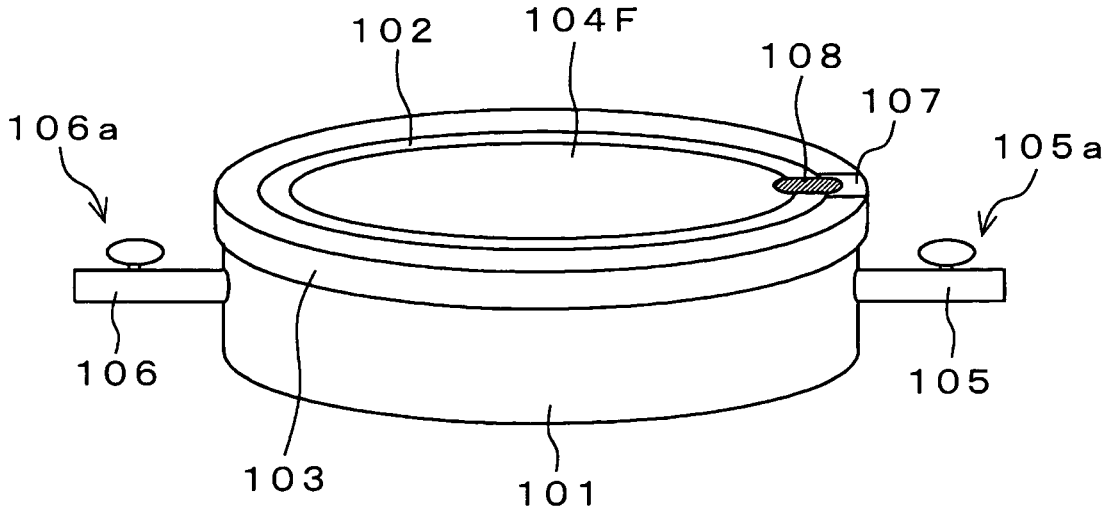
FIG. 3 is a perspective view of the electroacoustic transducer for showing an initial state of a diaphragm before it has been not formed.
Figure 4:
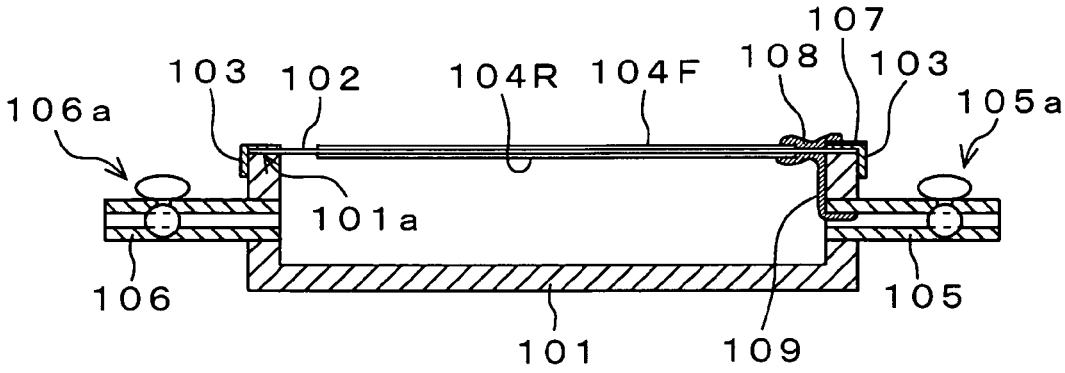
FIG. 4 is a cross-sectional view of the electroacoustic transducer for showing the initial state of the diaphragm before it has been not formed.

FIG. 3 is a perspective view of the electroacoustic transducer 100 for showing an initial state of the diaphragm 102. FIG. 4 is a cross-sectional view of the electroacoustic transducer 100 for showing the initial state of the diaphragm 102. It is to be noted that FIGS. 3, 4 show states where the open/close devices 105*a*, 106*a* are respectively set to their open positions. On the other hands, FIGS. 1, 2 show states where the open/close devices 105*a*, 106*a* are respectively set to their close positions.

On the initial state thereof, the air compressor, for example, supplies gas such as air into the chamber 101. Air pressure in the chamber 101 is increased by degrees and the diaphragm 102 fills out accompanying it to become convex. When a difference in the air pressure of the inside and outside of the chamber indicates maximum, the air compressor stops supplying the air into the chamber 101. Thus, the diaphragm 102 is formed to make maximum a difference in the air pressure of the front surface and the rear surface of the diaphragm 102, so that it can become convex.

It is to be noted that when a difference in the air pressure of the front surface and the rear surface of the diaphragm 102 indicates maximum, the open/close devices 105*a*, 106*a* of the ports 105, 106 are respectively closed (see FIGS. 1 and 2), thereby maintaining a formed shape of the diaphragm 102.

Figure 5:
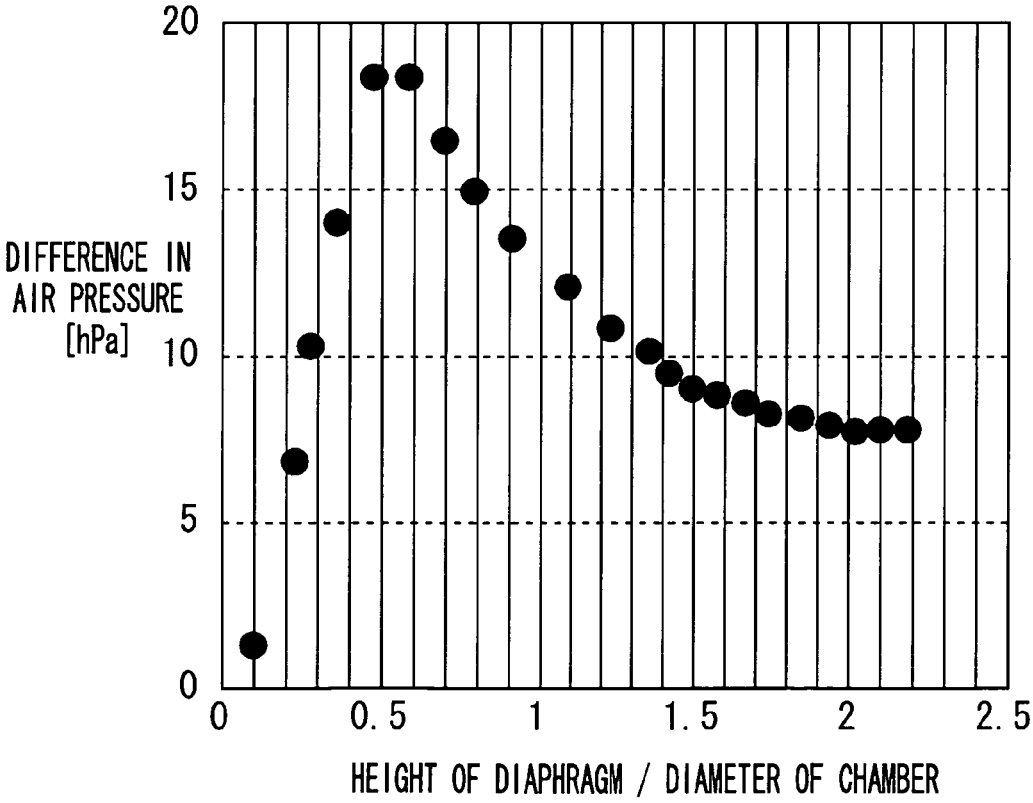
FIG. 5 is a graph for showing a measured example of a difference in air pressure of a front surface and a rear surface of the diaphragm when air is supplied into a chamber.

FIG. 5 shows a measured example of a difference in the air pressure of the front surface and the rear surface of the diaphragm 102 when air is supplied into the chamber 101. It is to be noted that as the diaphragm 102, the above-mentioned acrylic elastomer VHB 4910 manufactured by 3M having a thickness of 1 mm has been used in this measured example. Let a difference in air pressure (hPa) be a vertical axis in FIG. 5 and a ratio on a height H of the diaphragm 102 when being inflated to a diameter D of the chamber 101 a horizontal axis (see FIG. 2).

As clearly seen from this measured example, the difference in air pressure increases with the diaphragm 102 filling out from its initial state to a point where there is a maximum difference, but decreases thereafter. In this measured example, when H/D indicates 0.5, the difference in air pressure indicates 20 hPa, which is a maximum difference thereof.

As described above, the audio signal voltage biased by a direct-current biased voltage is applied across these adaptive electrode layers 104F, 104R, which are respectively formed on the front surface and the rear surface of the diaphragm 102.

A metallic terminal plate 107 for configuring a terminal on which the audio signal voltage is applied is arranged on a part of the retainer 103. This terminal plate 107 is electrically connected to the adaptive electrode layer 104F formed on the front surface of the diaphragm 102 via conductive paste 108. Further, the port 105 is electrically connected to the adaptive electrode layer 104R formed on the rear surface of the diaphragm 102 via conductive paste 109. This port 105 is used as a terminal on which the audio signal voltage is applied.

The above-mentioned audio signal voltage biased by a direct-current biased voltage is applied across the terminal plate 107 and the port 105, so that the audio signal voltage can be applied across these adaptive electrode layers 104F, 104R.

Figure 6:
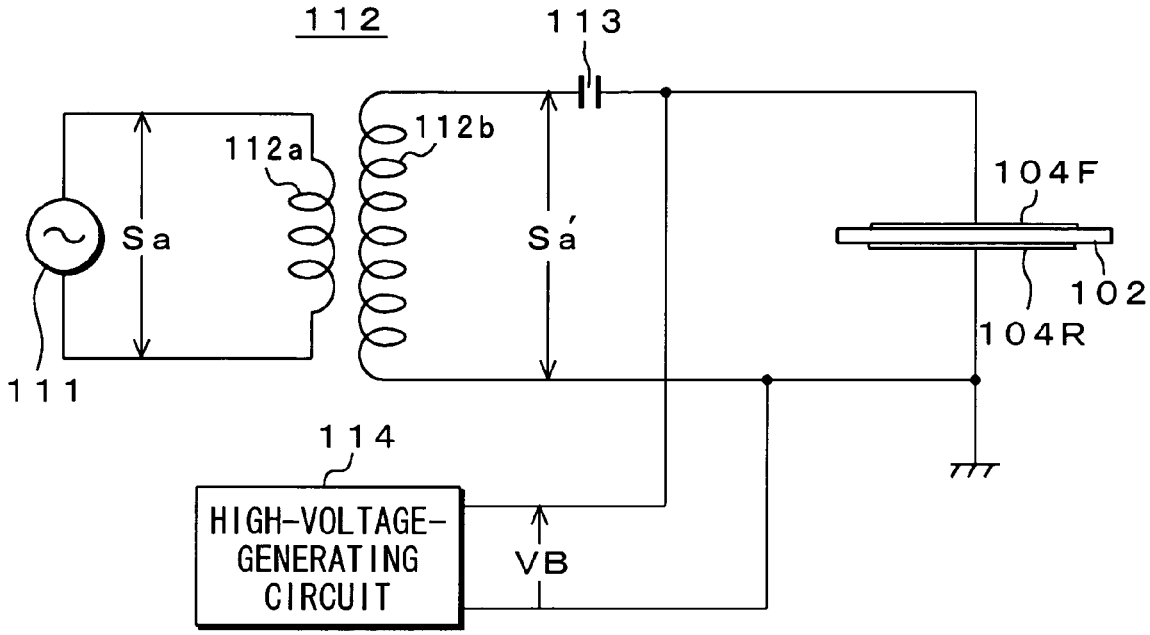
FIG. 6 is a circuit diagram for showing a configuration of a driving circuit in the electroacoustic transducer.

FIG. 6 shows a configuration of a driving circuit in the electroacoustic transducer 100. A primary coil 112*a* of a step-up transformer 112 receives the audio signal Sa from an audio signal source 111. This allows a secondary coil 112*b* of the step-up transformer 112 to obtain a boosted audio signal Sa'. An end of the secondary coil 112*b* of the step-up transformer 112 is directly connected to the adaptive electrode layer 104R that is grounded. The other end of the secondary coil 112*b* of the step-up transformer 112 is connected to the adaptive electrode layer 104F through a capacitor 113 for cutting a direct current.

A high-voltage-generating circuit 114 generates direct-current biased high-voltage VB. A negative side of this high-voltage-generating circuit 114 is connected to the adaptive electrode layer 104R. A positive side thereof is connected to the adaptive electrode layer 104F. This causes the boosted audio signal Sa' biased by the direct-current biased high-voltage VB to be applied across these adaptive electrode layers 104F, 104R.

Figure 7:
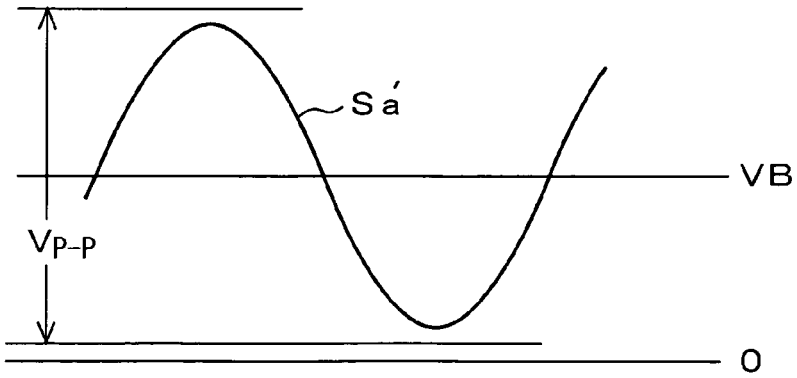
FIG. 7 is a graph for showing relationship between a level of direct-current biased voltage and a boosted audio signal in the driving circuit.

FIG. 7 shows a relationship between a level of direct-current biased high-voltage VB and the boosted audio signal Sa'. The direct-current biased high-voltage VB is set so that it can exceed at least a half of a peak-to-peak value Vp-p of the boosted audio signal Sa'. For example, when the peak-to-peak value Vp-p of the boosted audio signal Sa' is 4 kV, the direct-current biased high-voltage VB is set to be of 2 kV.

The following will describe operations of the electroacoustic transducer 100 shown in FIGS. 1 and 2. The boosted audio signal Sa' biased by the direct-current biased high-voltage VB is applied across these adaptive electrode layers 104F, 104R respectively formed on the front surface and the rear surface of the diaphragm 102 through the terminal plate 107 and the port 105.

The diaphragm 102 is made of the deformable electrostrictive polymer as described above so that, if voltage is applied across these adaptive electrode layers 104F, 104R, any attraction (Coulomb attraction) occurs between these adaptive electrode layers 104F, 104R, thereby decreasing a thickness of the diaphragm 102 to obtain an enlarged area thereof on its surface direction.

Since the diaphragm 102 obtains an enlarged area thereof on its surface direction by the direct-current biased high-voltage VB when the boosted audio signal Sa' biased by the direct-current biased high-voltage VB is applied across these adaptive electrode layers 104F, 104R as described above, the diaphragm 102 is deformed based on a change in a level of the boosted audio signal Sa'.

Since in this moment, the diaphragm 102 is formed to generate a difference in air pressure between the front surface and the rear surface of the diaphragm 102 so that the diaphragm 102 can be formed convex, as described above, the diaphragm 102 is deformed on its surface direction, thereby altering cubic capacity in a closed container constituted of the chamber 101 and the diaphragm 102 based on the difference in air pressure. This allows the diaphragm 102 to vibrate on its thickness direction based on a change in a level of the boosted audio signal Sa'. Thus, electric energy of the boosted audio signal Sa' is converted into acoustic energy so that the diaphragm 102 can emit an audio signal.

According to the above-mentioned electroacoustic transducer 100 shown in FIGS. 1 and 2, the diaphragm 102 is formed to make maximum a difference in air pressure of the front surface and the rear surface of the diaphragm so that it can be formed convex. This enables to be raised a maximum level of sound pressure that can be reproduced, thereby allowing the diaphragm to emit the audio signal efficiently. This is because the maximum level of sound pressure that can be reproduced is in proportion to the difference in air pressure between the inside and the outside of the chamber 101.

Suppose that the audio signal is emitted to all the directions, the maximum level of sound pressure SPLmax that can be reproduced within a range apart from a sound source by one meter is estimated as a following formula (1).

$$SPL\max = 20 \log 10 \left(\text{difference in air pressure}/\sqrt{2}/4\pi/0.00002\right) \quad (1)$$

This maximum level of sound pressure SPLmax corresponds to a sound pressure in a case where the diaphragm 102 is inflated to the maximum thereof by the audio signal and the direct-current biased voltage so that the difference in air pressure can become zero. In the formula (1), the difference in air pressure is divided by $\sqrt{2}$ to obtain a virtual value of the difference in air pressure; this virtual value thereof is divided by a surface area of a sphere having a radius of 1 m, $4\pi r^2$ (in this embodiment, r=1) to obtain a pressure by unit of area; the pressure by unit of area is divided by a reference pressure, 0.00002 (corresponding to 0 dB of the level of sound pressure) to obtain a magnification on the reference pressure; and using this magnification enables the maximum level of sound pressure SPLmax to be obtained. It is to be noted that if the difference in air pressure is 20 hPa as the measured example shown in FIG. 5, the maximum level of sound pressure SPLmax becomes 135 dB.

Although in the above embodiment, the diaphragm 102 has been formed to make maximum a difference in air pressure of the front surface and the rear surface of the diaphragm 102 so that it can be formed convex, the diaphragm 102 can be formed to make maximum a difference in air pressure of the front surface and the rear surface of the diaphragm 102 so that it can be formed concave.

In this case, on the initial state thereof (see FIGS. 3 and 4), air is exhausted from the chamber 101 through the port 105. Air pressure in the chamber 101 is decreased by degrees and the diaphragm 102 sinks accompanying it to become concave. When a difference in the air pressure of the inside and outside of the chamber indicates maximum, exhausting air from the chamber 101 is stopped.

Thus, the diaphragm 102 is formed to make maximum a difference in the air pressure of the front surface and the rear surface of the diaphragm 102, so that it can become concave. If the diaphragm 102 is formed concave, the electroacoustic transducer 100 can have the same excellent effect as that of the electroacoustic transducer in which the diaphragm 102 is formed convex.

Although in the above embodiment, the ports 105, 106 have been respectively provided with the open/close devices (cock mechanisms) 105*a*, 106*a*, the ports 105, 106 can be respectively provided with no open/close device. In this case, an opening of each of the ports 105, 106 is sealed with any sealing compounds or melted under a situation where a difference in air pressure of the front surface and the rear surface of the diaphragm 102 indicates maximum, thereby maintaining its enclosed condition.

Although in the above embodiment, the chamber 101 has been provided with the port 106 for measuring air pressure within the chamber 101 and the port 106 has been provided with, for example, the water manometer to measure a difference in air pressure between inside and the outside of the chamber 101 so that the diaphragm 102 can be formed concave or convex where the difference in air pressure indicates maximum, this invention is not limited thereto. A concave or convex shape of the diaphragm 102 is previously determined when the difference in air pressure indicates maximum and then, the diaphragm 102 may be formed according to such the shape. In this case, the port 106 of the chamber 101 can be omitted.

The present invention is applied to an electroacoustic transducer such as a speaker and a microphone using a diaphragm made of deformable electrostrictive polymer. It should be understood by those skilled in the art that various modifications, combinations, sub-combinations and alternations may occur depending on design requirements and other factors insofar as they are within the scope of the appended claims or the equivalents thereof.

What is claimed is:

1. An apparatus for making an electroacoustic transducer comprising:

an electroacoustic transducer including, a cup chamber;

a diaphragm made of deformable electrostrictive polymer, said diaphragm being attached to an opening of the chamber; and first and second adaptive electrode layers formed on a front surface and a rear surface of the diaphragm, across which audio signal voltage biased by a direct-current biased voltage is applied, said first and second adaptive electrode layers having shapes that are adjustable according to a change in a shape of the diaphragm;

a gas supplying device connected to a port of the cup chamber;

a pressure sensor configured to measure pressure within the cup chamber; and a controller configured to control the gas supplying device to supply gas into the cup chamber and to stop supplying gas when the pressure sensor senses that a difference in pressure between the cup chamber and ambient pressure is a maximum pressure difference.

2. A method for producing a diaphragm used in an electroacoustic transducer, the electroacoustic transducer having:

a cup chamber;

a diaphragm made of deformable electrostrictive polymer, said diaphragm being attached to an opening of the chamber; and first and second adaptive electrode layers formed on a front surface and a rear surface of the diaphragm, across which audio signal voltage biased by a direct-current biased voltage is applied, said first and second adaptive electrode layers having shapes that are adjustable according to a change in a shape of the diaphragm, said method comprising:

performing any one of supplying gas into the chamber and exhausting gas from the chamber; and when a difference in air pressure of the inside and the outside of the chamber indicates maximum, stopping performing any one of supplying the gas into the chamber and exhausting it from the chamber.

3. An apparatus for making an electroacoustic transducer comprising:

an electroacoustic transducer including, a cup chamber;

a diaphragm made of deformable electrostrictive polymer, said diaphragm being attached to an opening of the chamber; and first and second adaptive electrode layers formed on a front surface and a rear surface of the diaphragm, across which audio signal voltage biased by a direct-current biased voltage is applied, said first and second adaptive electrode layers having shapes that are adjustable according to a change in a shape of the diaphragm;

a gas removing device connected to a port of the cup chamber;

a pressure sensor configured to measure pressure within the cup chamber; and a controller configured to control the gas removing device to remove gas from the cup chamber and to stop removing gas when the pressure sensor senses that a difference in pressure between the cup chamber and ambient pressure is a maximum pressure difference.

* * * * *